US005373669A

United States Patent [19]

Paquette

[11] Patent Number: 5,373,669

[45] Date of Patent: Dec. 20, 1994

[54] FLAT-ROOF ROOFING WITH TAPERED CORRUGATED SHEET

[76] Inventor: Jean-Paul Paquette, 91, Rang des Étangs, Saint-Jean-Baptiste-de-Rouville Québec, Canada, J0L 2E0

[21] Appl. No.: 925,170

[22] Filed: Aug. 6, 1992

[51] Int. Cl.[5] ..... E04B 7/02; E04C 2/32

[52] U.S. Cl. ..... 52/90.2; 52/799; 52/800; 428/182

[58] Field of Search ..... 52/11, 13, 15, 90, 309.4, 52/309.8, 309.13, 801, 199, 408, DIG. 15, 799; 428/182

[56] References Cited

U.S. PATENT DOCUMENTS

| | | | |
|---|---|---|---|
| 669,148 | 3/1901 | Smith | 52/13 |
| 4,014,145 | 3/1977 | Groves | 52/199 |
| 4,285,175 | 8/1981 | Struben et al. | 52/90 |
| 4,503,644 | 3/1985 | Coutu, Sr. | 52/13 |
| 4,707,961 | 11/1987 | Nunley et al. | 52/408 |
| 4,719,723 | 1/1988 | Van Wagoner | 52/15 |

FOREIGN PATENT DOCUMENTS

| | | | |
|---|---|---|---|
| 0492286 | 7/1975 | Australia | 52/DIG. 15 |
| 2594160 | 11/1986 | France | 52/13 |

*Primary Examiner*—Carl D. Friedman
*Assistant Examiner*—Matthew E. Leno
*Attorney, Agent, or Firm*—Pierre Lespérance; Francois Martineau

[57] ABSTRACT

A roofing assembly for shieldingly covering the planking of a flat roof. At least one water drainage outlet is provided about a portion of its surface. The roofing assembly comprises: (a) a thick, substantially flat insulating batt; (b) top waterproofing membranes, gravel layer and cardboard layer;, and bottom waterproofing membranes and gypsum layer, being respectively applied on top and bottom walls of the insulating batts; (c) a rigid, corrugated sheet member, applied directly under the bottom gypsum layer and supporting the insulating batt and destined to be applied directly against the roof planking. The corrugated sheet member is formed by a thin rigid sheet, this thin sheet undulating in a wave-like pattern along a lengthwise direction, whereby the corrugated sheet member has a depth formed by the transverse gap between a successive pair of trough and crest of the wave-like thin sheet. Hence, the undulating sheet member depth tapers toward the water drainage outlet port, so that rainwater falling over the roofing assembly will be biased under gravity toward the water drainage outlet.

11 Claims, 5 Drawing Sheets

FLAT-ROOF ROOFING WITH TAPERED CORRUGATED SHEET

FIELD OF THE INVENTION

This invention relates to roofings for covering so-called flat roofs.

BACKGROUND OF THE INVENTION

Buildings provided with flat roofs are conventionally covered with a roofing assembly. This roofing assembly is supported by the generally horizontal planking of the roof. The top face of the roofing assembly is itself not horizontal, since it is desirable and in fact required to provide a slope to this top face, slope being directed toward a water drainage outlet port located usually centrally of the roof. Hence, as rainwater falls over the roof, it will slide toward and into the water outlet to escape from the roof, thereby preventing water accumulation thereon.

In conventional roofing assemblies, the slope of the top face thereof is made possible by the tapering of the rigid, flat, insulating batts, which form part of the roofing assembly, toward said water outlet port. This tapering of the insulating material of the roof is undesirable, since it means that heat retention capability of the roof is not of uniform distribution. This in turn means that heating costs for the building will be more difficult to control.

OBJECTS OF THE INVENTION

The gist of the invention is to provide a roofing assembly for flat-roof, which will be of constant thermal insulating properties over substantially all its surface.

A corollary object of the invention is to provide such a roofing assembly, where the tapering of the roofing element responsible for the roofing top face slope is made according to a very cost-effective manufacturing method.

SUMMARY OF THE INVENTION

In accordance with the objects of the invention, there is disclosed a roofing assembly for shieldingly covering the planking of a flat roof, said flat roof defining at least one water drainage outlet means about a portion of its surface, said roofing assembly comprising: (a) a thick, substantially flat, thermally insulating member; (b) top and bottom waterproofing members, applied on top and bottom walls of said flat insulating members; (c) a rigid, corrugated member, applied directly under said bottom waterproofing member and supporting said insulating member and said waterproofing members and destined to be applied directly against said roof planking; said corrugated member being formed by a thin rigid sheet, said thin sheet undulating in a wave-like pattern along a lengthwise direction, whereby said corrugated member has a depth formed by the transverse gap between a successive pair of trough and crest of said wave-like thin sheet; wherein said undulating sheet member depth tapering toward said water drainage outlet means, so that rainwater falling over said roofing assembly will be biased under gravity toward said water drainage outlet means.

BRIEF DESCRIPTION OF THE DRAWINGS

FIGS. 2–2*a* are cross-sections of the flat roof about either one of lines 2—2 of FIG. 1, FIG. 2 showing a prior art roof assembly with a constant thickness corrugated sheet member, while FIG. 2*a* shows a preferred first embodiment of flat roof assembly with a progressively decreasing thickness corrugated sheet member;

DETAILED DESCRIPTION OF THE INVENTION

Figure 1:
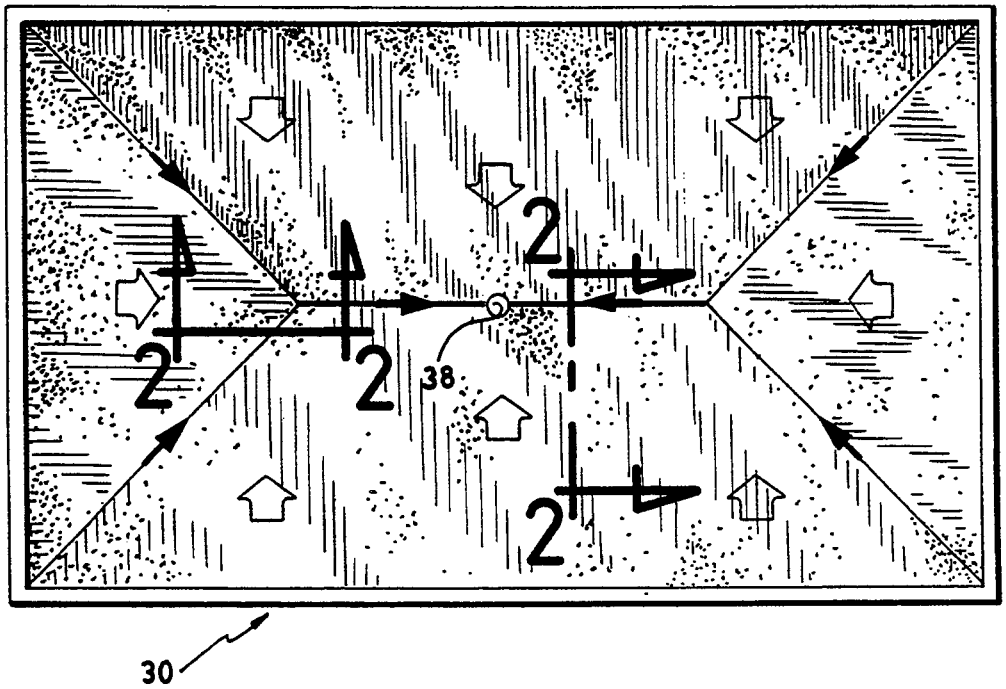
FIG. 1 is a top plan view of a first embodiment of flat roof building.
Figure 2:
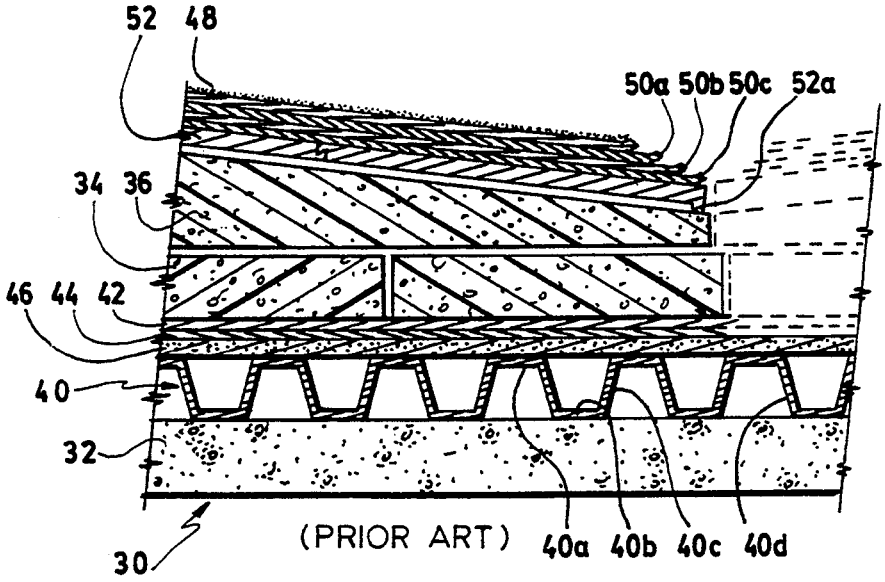

A conventional flat roof construction is shown in FIGS. 1–2 and is referenced by 30. Flat roof 30 consists of a main, horizontal roof planking 32, supported by horizontally extending structural joists 35, see FIG. 2*a*, from the building supporting framework. A first layer of insulating batts 34, of generally constant thickness, is laid over planking 32. Second batts 36 are laid over first batts 34, and they thicknesswisely taper, whereby an inturned, downward slope is defined, wherein the roof 30 forms a funnel opening downwardly toward a central water drainage outlet port 38. A corrugated rigid sheet member 40, of constant thickness, is interposed between lower planking 32 and insulating batts 34, to maintain the panel 32 and batts 34 spaced at a vertical distance from one another. Waterproofing flexible layers 42, 44, and gypsum layer 46 are laid between batt 34 and corrugated sheet member 40.

As clearly seen in FIG. 2, corrugated metal sheet member 40 forms a trapezoidal wave shape, defining alternating, top and bottom, horizontal flat wall segments 40*a*, 40*b* and inclined, diverging wall segments 40*c*, 40*d*. Top wall segment 40*a* come in direct contact with and flatly supports gypsum layer 46, while bottom wall segment 40*b* directly engages and bears against base panel 32.

A gravel sheathing 48 is laid over the top of roof construction 30. Additional flexible waterproofing sheets 50*a*, 50*b*, 50*c* supported by a cardboard panel 52, are laid between gravel layer 48 and tapered batts 36. Cardboard panel 52 usually includes edgewise legs 52*a*, thus maintaining the main portion by panel 52 slightly spaced above rigid tapered insulating batt 36.

It is understood that it is the tapered insulating batts 36 that create the slopewise inclination of topmost gravel layer 48, whereby rainwater falling on top roof layer 48 will slide by gravity toward central outlet port 38. All the other elements of roof assembly 30 remain of substantially constant thickness along the whole area of roof assembly 30. Hence, in conventional flat roof 30, upper layers 48, 50, 52 are inclined, while lower layers 34, 42, 44, 46, and 40 are not (they are horizontal, i.e. parallel to roof planking 32).

Figure 2A:
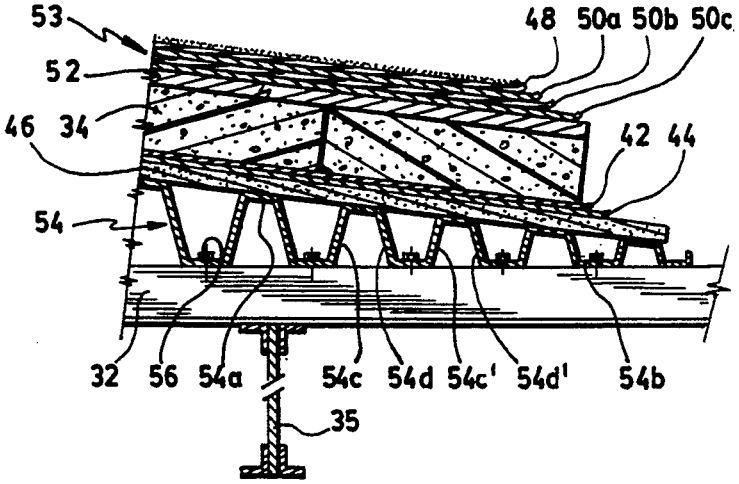

In the preferred embodiment of flat roof construction of the invention, as shown as 53 in FIG. 2*a*, tapered rigid insulating batts 36 are completely removed from the flat roof construction, while constant thickness corrugated rigid sheet members 40 are replaced by thicknesswisely tapering, trapezoidal wave shaped corrugated sheet members 54. By thicknesswisely tapering, it is not meant that the thickness of the sheet itself varies (it should in fact remain substantially constant), but rather, that the height of the diverging legs 54*c*, 54*d* of each two pairs of successive legs 54*c*–54*d*, 54*c*–54*d* is decreasing in stepwise fashion, toward the water outlet port 38. That is to say, while each successive pair of upstream legs 54*c* and downstream leg 54*d* are of constant height, the next (downstream) leg 54*c*′ is of a smaller relative height. The leg 54*d*′ (slopewisely) downstream of leg 54*c*′ has the same height as this latter leg. And so on toward and until water outlet 38 is reached.

While the bottom legs 54*b* are generally horizontal, as was the case for bottom legs 40*b* of corrugated sheet member 40, the top legs 54*a* are preferably also sloped, i.e. inclined downwardly toward water outlet port 38. The reason why top legs 54*a* of corrugated sheet member 54 are not horizontal but sloped, is to make sure that the overlying section of the whole assembly of roof elements 42–52 remain parallel over the plane of successive top legs 54*a*, and that gypsum layer lay directly and flatly against top legs 54*a*. Also, bottom horizontal legs 54*b* will preferably be anchored to bottom planking 32, e.g. by bolts 56, to prevent laterally outward shifts of corrugated sheet members 54 away from outlet port 38, under the load of heavy rainwater.

Figure 4:
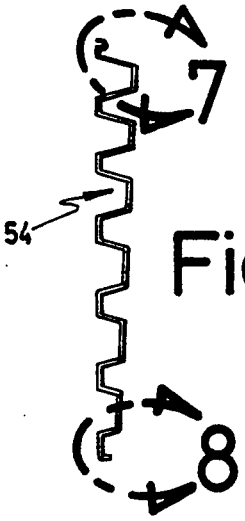
FIGS. 4 and 6 are lateral edge views of the sheet members of FIGS. 3 and 5, respectively.
Figure 5:
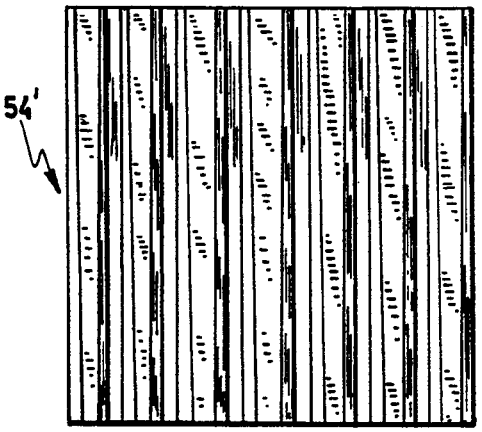
Figure 6:
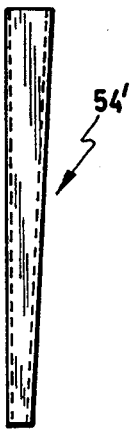
Figure 7:
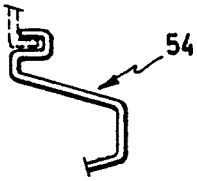
FIGS. 7–8 are enlarged views of areas 7 and 8 of FIG. 4.
Figure 8:
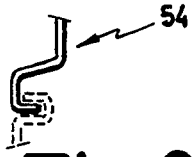
Figure 9:
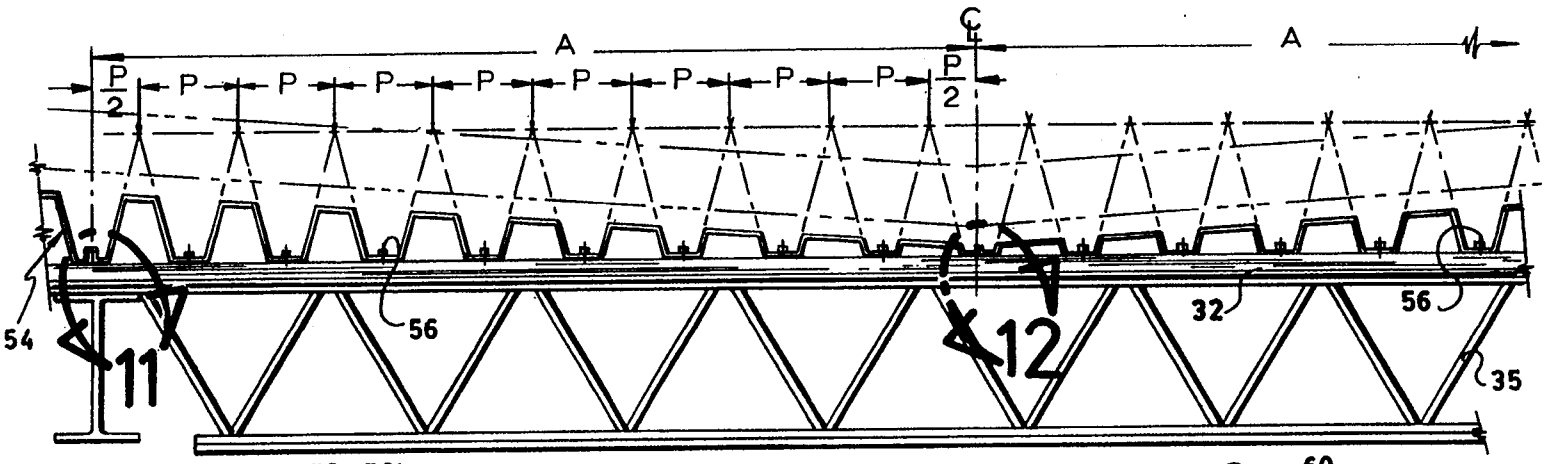
FIG. 9 is a schematic, enlarged cross-section of the present flat roof assembly.
Figure 12:
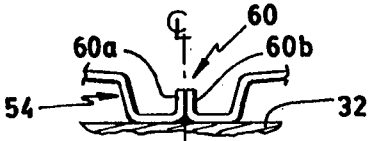
FIGS. 11–12 are enlarged views of areas 11 and 12 respectively of FIG. 9.
Figure 11:
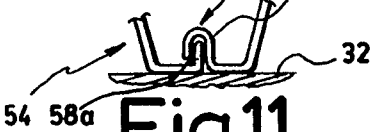

FIGS. 5–6 suggest that the tapering of corrugated sheet member 54 nee not necessarily be in a direction transverse to the longitudinal axis of top elongated crests 54*a* of trapezoidal wave shape corrugated sheet member 54. That is to say, in the embodiment of corrugated sheet member shown as 54′ in FIGS. 5–6, the tapering thereof would occur longitudinally of top elongated crests 54*a*, with top crests 54*a* directed toward water outlet port 38. Hence, whereas in the first preferred embodiment of corrugated sheet member 54 shown in FIGS. 2*a*, 3 and 4, the height of each given crest remained constant throughout its length while that of successive crests decreased in steps, in the alternate embodiment of corrugated sheet member 54′ shown in FIGS. 5–6, the height of each crest 54′*a* progressively decreases in continuous fashion.

Figure 3:
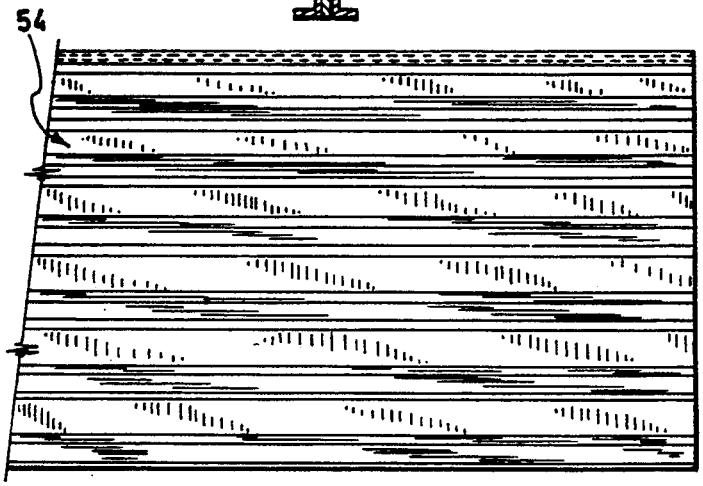
FIGS. 3 and 5 are top plan views of two embodiments of corrugated sheet members for a flat roof assembly according to the invention.
Figure 10:
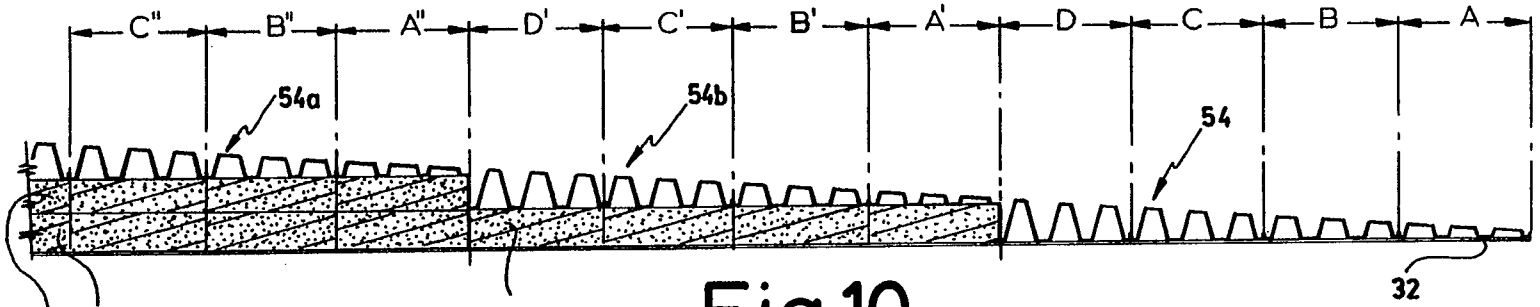
FIG. 10 is another schematic cross-section at a reduced scale of a flat roof assembly of large overall area, suggesting how the corrugated sheet members can be step-laden on insulating boards.
Figure 13:
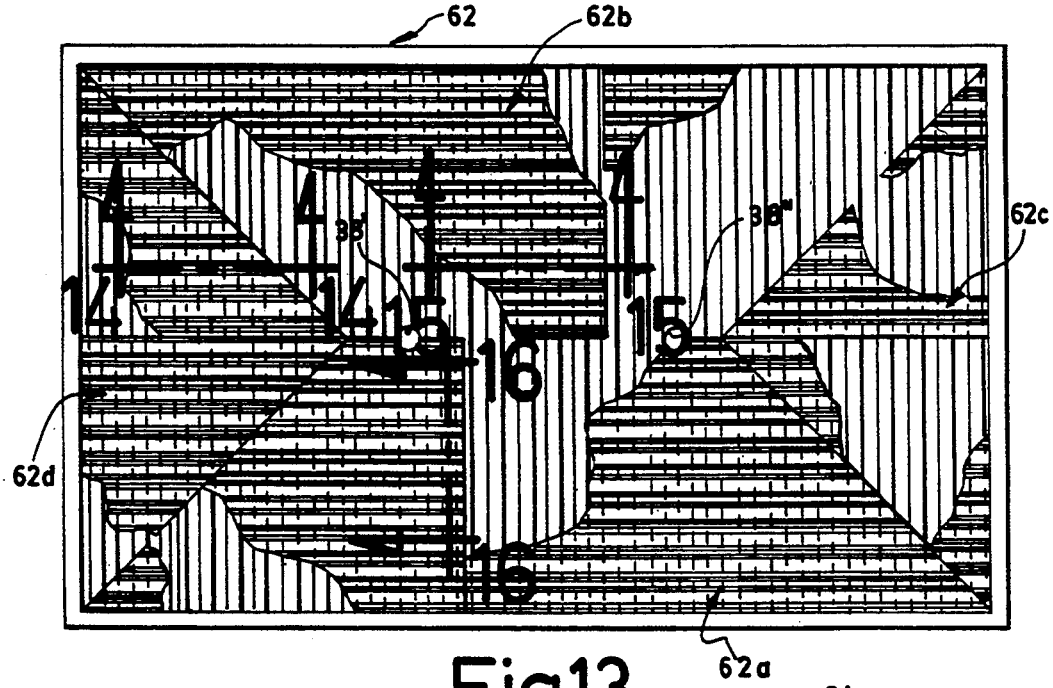
FIG. 13 is a partly cut-away, top plan view of a two-drain flat roof.
Figure 14:
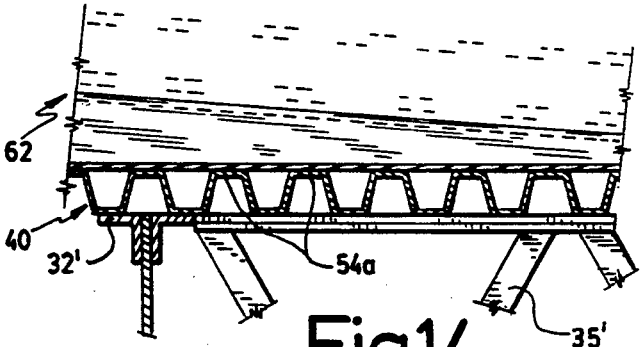
FIGS. 14–16 are enlarged cross-sections along lines 14—14, 15—15 and 16—16 respectively of FIG. 13.
Figure 15:
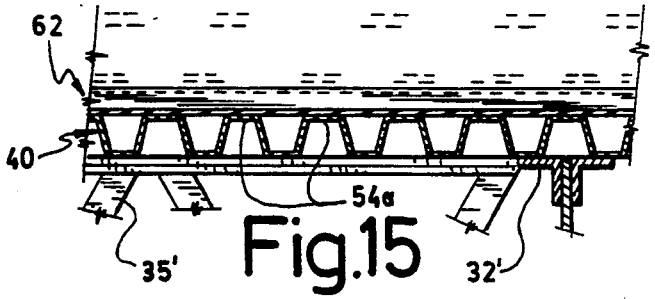

FIG. 10 is provided to show how the preferred corrugated sheet members 54, 54*a*, 54*b*, . . . of FIGS. 3–4 can be fitted over a wide area flat roof construction, which requires more than one sheet member 54. This would be made possible with providing additional layers of constant thickness insulating batts 34*a*, beneath corrugates sheet member 54 as one moves farther away from water outlet port 38. This is clearly suggested in FIG. 10, with the water outlet port 38—not illustrated—being at the right hand side edge of the figure, the first corrugated sheet member 54 adjacent outlet port 38 bears directly against planking 32, the second corrugated sheet member member 54*a* away from port 38 against a single layer of constant thickness insulating batts 34*a*, the third corrugated sheet member member 54*b*, still farther away from porot 38, against a double layer of constant thickness insulating batts 34*b*, and so on. Please remember that these insulating batts 34*a*, 34*b*, 34*c*, . . . which are located beneath the corrugated sheet members 54*a*, 54*b*, (but not beneath the corrugates sheet member 54 closest to part 38) do not replace the original insulating batts 34, which are located above all the corrugated sheet members 54, 54*a*, 54*b*, . . . . It is important, of course, in view of reducing thermal losses, that the overall surface of flat roof 30 be covered by a substantially continuous layer of the overlying insulating batts 34.

FIGS. 7–8 and 11–12 show how the different corrugated sheet members 54, 54*a*, 54*b* are edgewisely interconnected to one another.

As suggested in FIG. 10, each corrugated sheet member 54, 54*a* or 54*b* preferably consists of a number of interconnected sheet segments, for example four segments identified by A, B, C and D in FIG. 10. Successive segments of corrugated sheet members 54 are interconnected by releasable, male-female joints, illustrated in FIG. 11 as 58. Each joint 58 includes an upturned straight lip 58*a*, forming the edge of the smallest height portion of one segment of corrugated sheet member 54, say segment A, and a J-shaped flange 58*b*, formed by the edge portion of the largest height portion of the other segment—B in this case. On the other hand, around water outlet port 38, a butt joint 60 is defined, where the upturned lips 60*a*, 60*b* forming the edge of the smallest height portion of adjacent segments of corrugated sheet member 54.

FIGS. 13–16 show how corrugated sheet member 54 can be installed onto a flat roof construction 62, having separate water outlet ports 38′, 38″, and including bottom planking 32′ and supporting framework 35′. The rectangular roof 62 shown in in plan view in FIG. 13 includes two trapezoidal roof sections 62*a*, 62*b* on the long sides thereof, and two equilateral triangular roof sections 62*c*, 62*d* on the short sides thereof. The two spaced water outlet ports 38′, 38″ are located at the merger of trapezoidal wave sections 62*a* and 62*b*, proximate triangular sections 52*c*, 62*d* respectively.

Figure 16:
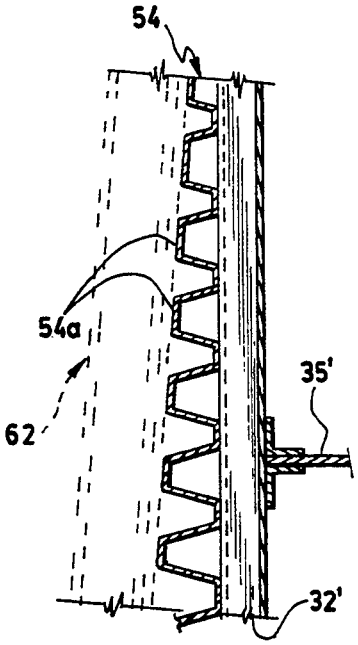

Roof sections 62*a*–62*d* are all inclined downwardly and inwardly, see FIG. 16, so that rainwater will fall under gravity toward water outlet ports 38′, 38″. Thus, corrugated sheet members 54 taper toward the virtual line joining spaced water ports 38′, 38″.

Figure 17:
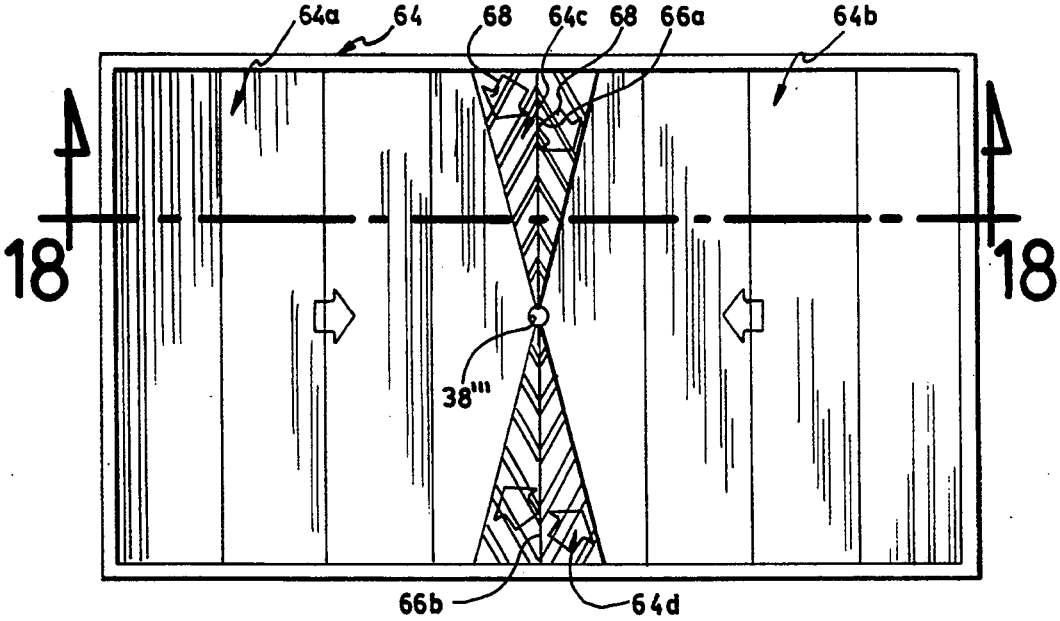
FIG. 17 is a top plan view of an alternate flat roof construction.
Figure 18:
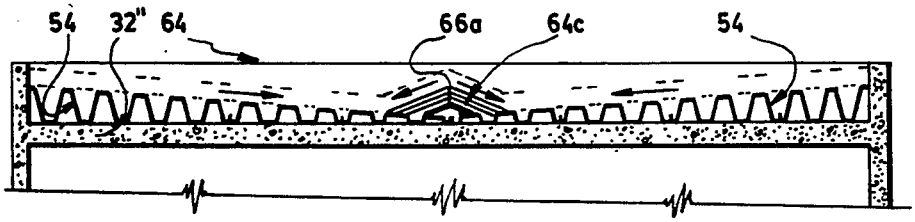
FIG. 18 is a section along line 18—18 of FIG. 17, showing the chamfering corrugated sheet members.
Figure 19:
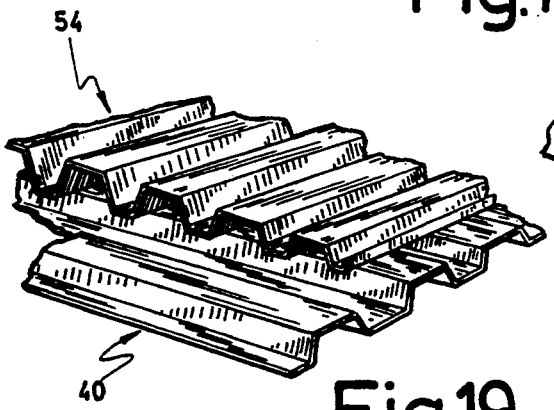
FIGS. 19–20 show in partly broken isometric views two assemblies of pair of superimposed corrugated sheet member for flat roof construction.

An alternate embodiment of flat roof construction is illustrated in FIGS. 17–18 and referenced as 64. Rectangular roof 64 includes a single central water outlet port 38‴, and two sloped half roof sections 64*a*, 64*b*, being sloped downwardly inwardly toward port 38‴. To prevent rainwater from accumulating at the mid-line 66*a*, 66*b* edgewisely between the two half roof sections 64*a*, 64*b*, the mid-line portions 66*a*, 66*b* (on opposite sides respectively of water outlet port 38‴) are raised. Thus, one obtains two opposite, triangular, sloping roof sections 64*c*, 64*d*.

Each sloping roof section 64*c*, 64*d* forms an inverted V-shape in cross-section, as suggested in FIG. 18, whereby rainwater falling thereover will slide obliquely toward and over the inner edge portions of half roof portions 64*a*, 64*b*, as suggested by arrows 68, before eventually reaching and escaping through water outlet port 38'''. Again, the slope of triangular roof sections 64*c*, 64*d* is provided by thicknesswisely tapering, trapezoidal wave shape, corrugated sheet member 54.

Figure 20:
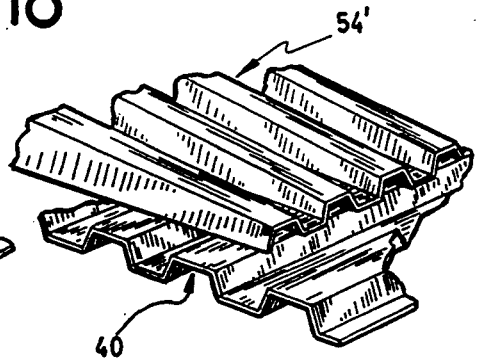

As clearly illustrated in FIG. 20, according to one embodiment of the invention, the elongated crests of the corrugated sheet member, 54', taper lengthwisely thereof.

I claim:

1. Roofing assembly for shieldingly covering a roof planking of a flat roof, said flat roof defining at least one water drainage outlet means about a portion of its surface, said roofing assembly comprising:

(a) a substantially flat, thermally insulating member;

(b) top and bottom waterproofing members, applied on top and bottom walls of said flat insulating member;

(c) a rigid, corrugated sheet member, applied directly under said bottom waterproofing member and supporting said insulating member and said waterproofing members and to be applied directly against said roof planking; said corrugated sheet member being formed by a thin rigid sheet, said thin sheet undulating in a wave-like pattern along a lengthwise direction, whereby said corrugated sheet member has a depth formed by the transverse gap between a successive pair of trough and crest of said wave-like thin sheet; wherein said corrugated sheet member depth tapers toward said water drainage outlet means, so that said top waterproofing member forms a sloping surface and so that said rainwater falling over an uppermost surface of said roofing assembly will slide under the force of gravity toward said water drainage outlet means.

2. A roofing assembly as defined in claim 1, wherein said corrugated sheet member is of generally trapezoidal wave shape in cross-section.

3. A roofing assembly as defined in claim 2, wherein said corrugated sheet member crests are elongated and taper lengthwisely thereof.

4. A roofing assembly as defined in claim 2, wherein said corrugated sheet member crests are elongated and taper transversely thereof.

5. A roofing assembly as defined in claim 4, wherein each of said crests is flat and extends within a plane generally parallel to said uppermost surface of roofing assembly.

6. A roofing assembly as defined in claim 2, wherein an additional corrugated sheet member is provided and releasably attached by connector means to a selected, slopewise edge portion defined by the first mentioned corrugated sheet member.

7. A corrugated sheet member for use in a roofing assembly of a flat roof, said flat roof being of the type defining at least one water drainage outlet means about a portion of its surface, said roofing assembly of the type comprising a thick, substantially flat, thermally insulating member, and top and bottom waterproofing members, applied on top and bottom walls of said flat insulating member; wherein said corrugated sheet member is to be applied directly under said bottom waterproofing member and to support said insulating member and said waterproofing members and to be applied directly against a bottom planking defined by the roof, said corrugated member being formed by a thin rigid sheet, said thin sheet undulating in a wave-like pattern along a lengthwise direction, whereby said corrugated sheet member has a depth formed by the transverse gap between a successive pair of trough and crest of said wave-like thin sheet, said corrugated sheet member depth tapering toward said water drainage outlet means, so that rainwater falling over said roofing assembly will be biased under the force of gravity toward said water drainage outlet means.

8. A corrugated sheet member for use in a roof as defined in claim 7, wherein said corrugated sheet member is of generally trapezoidal wave shape in cross-section.

9. A corrugated sheet member for use in a roof as defined in claim 8, wherein said corrugated sheet member crests are elongated and taper lengthwisely thereof.

10. A corrugated sheet member for use in a roof as defined in claim 8, wherein said corrugated sheet member crests are elongated and taper transversely thereof.

11. A corrugated sheet member for use in a roof as defined in claim 8, wherein each of said crests is flat and extends within a plane to be generally parallel to an uppermost surface of said roofing assembly.

* * * * *